US006762372B2

(12) United States Patent
Nishimoto et al.

(10) Patent No.: US 6,762,372 B2
(45) Date of Patent: Jul. 13, 2004

(54) MULTIDIRECTIONAL INPUT DEVICE

(75) Inventors: Takumi Nishimoto, Okayama (JP); Jun Sato, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/643,904

(22) Filed: Aug. 20, 2003

(65) Prior Publication Data

US 2004/0060807 A1 Apr. 1, 2004

(30) Foreign Application Priority Data

Aug. 27, 2002 (JP) ..... 2002-246534

(51) Int. Cl.[7] ..... H01H 9/00; H01H 25/00

(52) U.S. Cl. ..... 200/4; 200/5 R; 200/6 A; 200/18

(58) Field of Search ..... 200/4, 5 R, 5 A, 200/6 A, 11 R–11 TW, 17, 18, 553, 557

(56) References Cited

U.S. PATENT DOCUMENTS 5,952,628 A * 9/1999 Sato et al. ..... 200/4
6,049,044 A * 4/2000 Mizobuchi ..... 200/4
6,262,381 B1 * 7/2001 Kikuchi et al. ..... 200/6 A

FOREIGN PATENT DOCUMENTS

JP 2000-048681 2/2000

* cited by examiner

*Primary Examiner*—James R. Scott
(74) *Attorney, Agent, or Firm*—Wenederoth, Lind & Ponack, L.L.P.

(57) ABSTRACT

A multidirectional input device includes a top substrate holding an electronic component having an operating shaft at its center; a frame surrounding this top substrate; and a bottom substrate on which plural push switches are disposed. Both substrates are rockably configured along two rocking axes intersecting at right angles which are perpendicular to a rotation axis of the operating shaft. This configuration allows to output a signal different for each pressing, rotating, or rocking operation of the operating shaft. The multidirectional input device with a comfortable tactile feedback during use can be assembled in advance as an independent device.

13 Claims, 13 Drawing Sheets

MULTIDIRECTIONAL INPUT DEVICE

BACKGROUND OF THE INVENTION

1. Field of the Invention

The present invention relates to multidirectional input device employed in in-vehicle electronic apparatuses such as car multimedia and navigation systems.

2. Background Art

Rapid advances are being seen in recent years in features of in-vehicle electronic apparatuses such as car multimedia and navigation systems. Since these electronic apparatuses are installed in the limited space available in a vehicle, input devices for operating these multi-functional apparatuses are needed to allow the use of a single operating knob for inputting in multiple directions.

Japanese Laid-open Patent No. 2000-48681 is one example of this type of conventional multidirectional input device. This input device outputs signals by rotating and pressing an operating shaft, which can also be tilted in any direction.

An electronic component for rotating and pressing operation is employed, and this electronic component is configured on a printed wiring board of an in-vehicle electronic apparatus to generate signals also by tilting operation the operating shaft.

This conventional multidirectional input device is described with reference to FIGS. 14 to 18.

FIG. 14 is a front view, partly in section, showing a conventional multidirectional input device. Printed wiring board 610 of the in-vehicle electronic apparatus, electronic component for rotating and pressing operation 620, operating shaft 630, and auto-return push switches 641 to 644 are shown in the drawings.

In electronic component for rotating and pressing 620 (hereafter simply referred as electronic component 620), polygonal sphere 651, whose horizontal section is a polygon, of operating shaft 650 is inserted into polygonal hole 661 at the center of rotor 660 in a vertically movable fashion but rotates together with rotor 660, as shown in a front sectional view in FIG. 15.

When operating shaft 650 is rotated, contact plate 670 rotates via rotor 660. Resilient contacts 681 and 682 which resiliently and in sliding fashion contact this contact plate 670 configure rotary encoder 690 as a rotary section, and output signals. When operating shaft 650 is pressed, dome-shaped flexible contact 710 is pressed downward via driver 700 which contacts the bottom end of operating shaft 650.

Pressed flexible contact 710 short-circuits between fixed contacts 721 and 722 to make switch 730, the pressing section, output signals. When operating shaft 650 is tilted, operating shaft 650 tilts smoothly in polygonal hole 661 of rotor 660 rotating about the center of polygonal sphere 651 of operating shaft 650.

As shown in FIG. 16 which is a sectional view taken along Line 16—16 in FIG. 14, four push switches 641 to 644 are disposed in four directions at 900 intervals on the same radius, centering on operating shaft 650 of electronic component 620. Bottom peripheral end 631 of a larger diameter of knob 630 mounted on the tip of operating shaft 650 of electronic component 620 contacts push buttons 741 to 744. The operation stroke of these four push switches 641 to 644 is set to be longer than that of switch 730 of electronic component 620.

When knob 630 of the multidirectional input device as configured above is rotated, operating shaft 650 of electronic component 620 rotates rotor 660 to make rotary encoder 690 output signals. When knob 630 is pressed, the bottom part of operating shaft 650 pushes driver 700 such that switch 730 activates and outputs signals, as shown in the front sectional view in FIG. 17.

When knob 630 is pressed, peripheral bottom end 631 also pushes buttons 741 to 744 of push switches 641 to 644. However, four push switches 641 to 644 are not activated because the operation stroke of these switches is longer than the operation stroke of switch 730. When knob 630 is tilted in the required direction, for example to the left as shown by the arrow in the front-view cross section in FIG. 18, button 741 at the tilted direction is pressed so that push switch 641 activates and outputs signals.

In the conventional multidirectional input device, however, the multidirectional input device is configured on the printed wiring board of the electronic apparatus. This increases the possibility of positional deviation between constituents of the input device. In addition, bottom peripheral end 631 needs to remain in contact with the top face of buttons 741 to 744 of four push switches 641 to 644 to prevent looseness of knob 630 in the normal state. This makes bottom peripheral end 631 slide on the top face of four push buttons 741 to 744 when knob 630 is rotated, generating an uncomfortable tactile feedback during use.

SUMMARY OF THE INVENTION

The present invention solves the above disadvantage of the prior art. The present invention aims to offer a multidirectional input device that can be assembled as an independent device before mounting it on a printed wiring board of an electronic apparatus. The operating knob has no looseness, and rotates with a comfortable touch. In addition, erroneous operations are reduced.

The multidirectional input device of the present invention includes:

(a) an electronic component for outputting signals in response to rotation and pressing of the operating section;

(b) a top substrate holding the electronic component at its center which is rockable about a first support pin on a first rocking axis perpendicular to the rotation axis of the operating section;

(c) a frame surrounding the top substrate and having an rocking support for the first support pin, and is rockably supported centering by a second support pin on a second rocking axis perpendicular to the rotation axis and at right angles to the first rocking axis;

(d) a bottom substrate having a support for the second support pin; and (e) multiple push switches disposed on the bottom substrate such as to contact the bottom face of the top substrate. The push switches are disposed at an equal distance and equal angular interval centering on a crossing point of the first rocking axis and second rocking axis.

The top substrate tilts toward the bottom substrate by tilting the operating section, and one or two push switches are activated.

DETAILED DESCRIPTION OF THE INVENTION

Exemplary embodiments of the present invention are described below with reference to the drawings.

First Exemplary Embodiment

Figure 1:
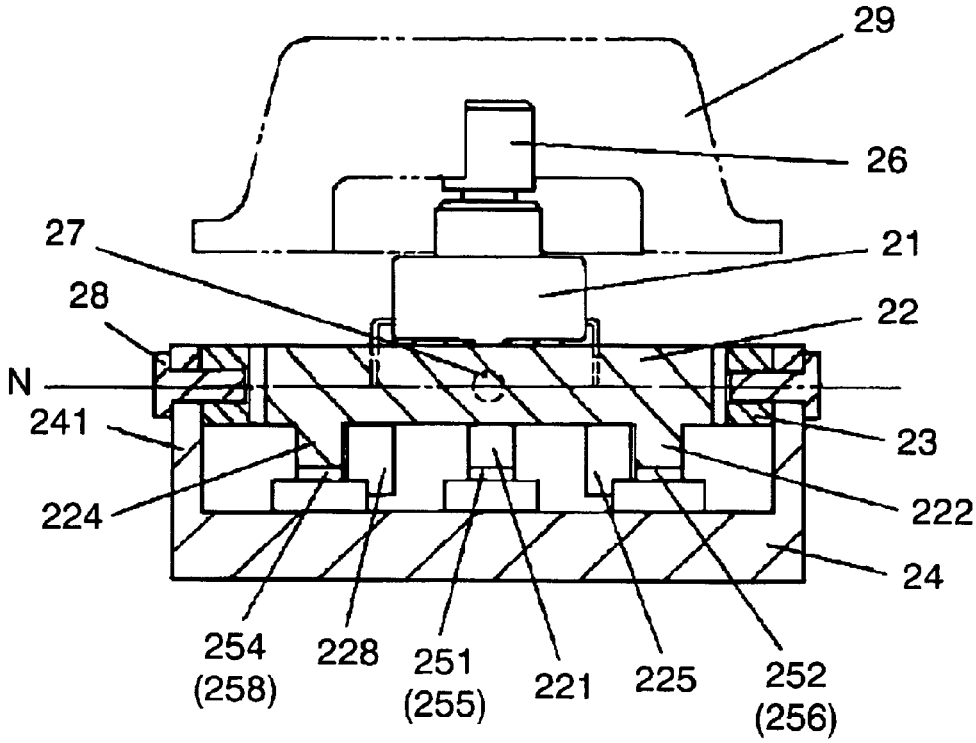
FIG. 1 is a front view, partly in section, of a multidirectional input device in accordance with a first exemplary embodiment of the present invention.
Figure 2:
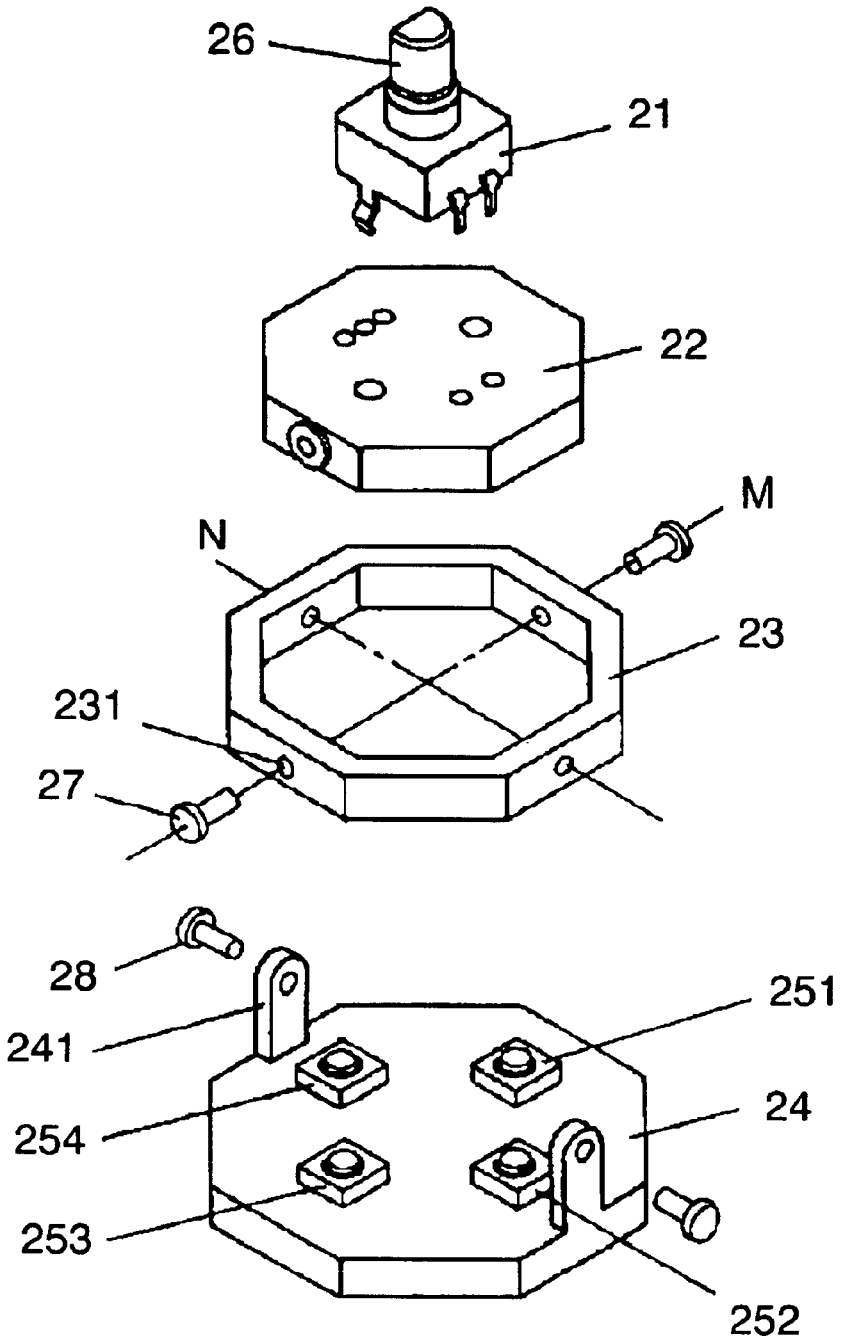
FIG. 2 is an exploded perspective view of the multidirectional input device in accordance with the first exemplary embodiment of the present invention.
Figure 3:
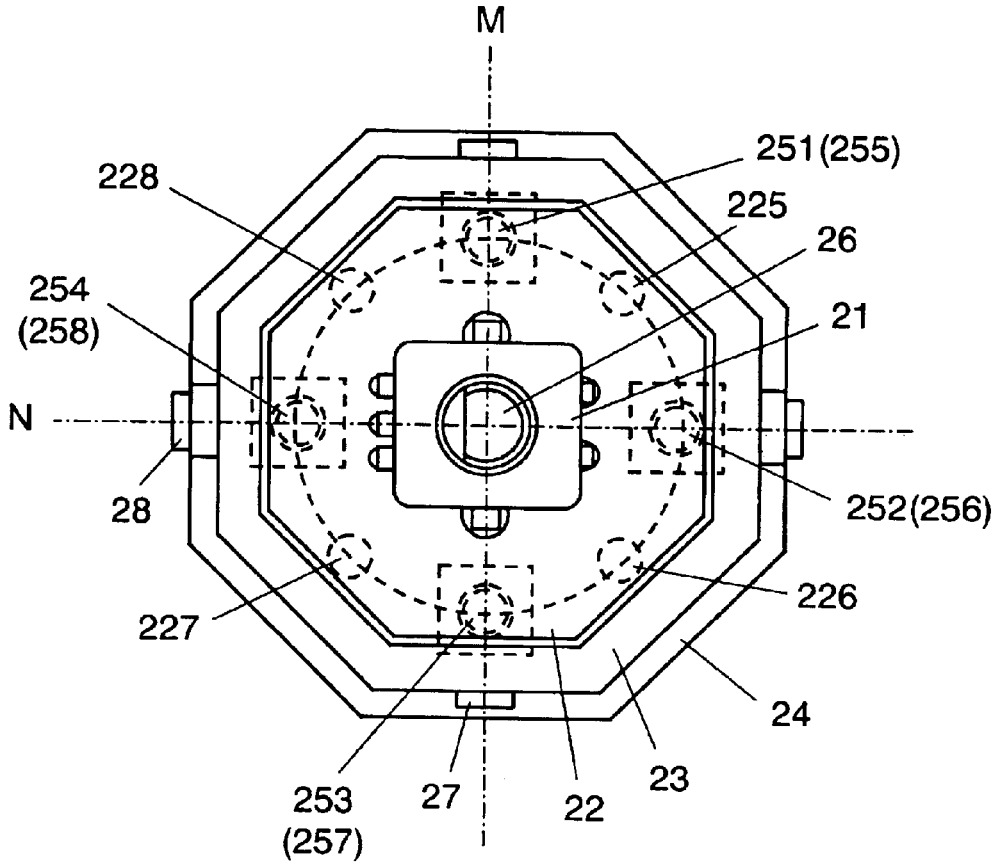
FIG. 3 is a plan view of the multidirectional input device in accordance with the first exemplary embodiment of the present invention.

FIG. 1 is a front view, partly in section, showing a multidirectional input device in the first exemplary embodiment of the present invention. FIG. 2 is an exploded perspective view, and FIG. 3 is a plan view. In these drawings, top substrate 22 holds electronic component for rotating and pressing operation 21. Frame 23 is disposed around top substrate 22. Bottom substrate 24 rotatably supports these members. Push switches 251 to 254 are auto-return switches.

Figure 4:
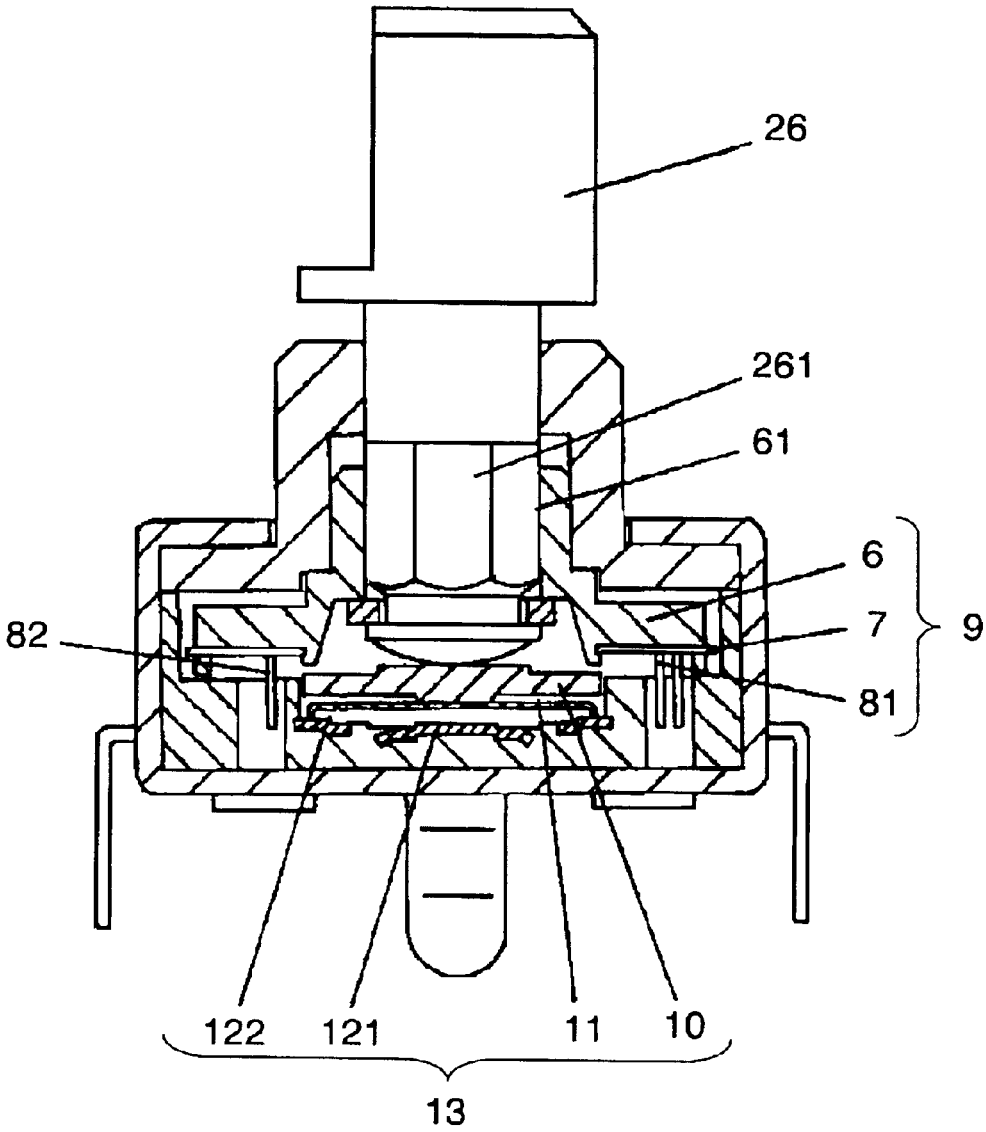
FIG. 4 is a front sectional view of an electronic component for rotating and pressing operation which is a key part in FIG. 1.

In electronic component for rotating and pressing operation 21 (hereafter simply referred as electronic component 21), as shown in a front sectional view in FIG. 4, contact plate 7 rotates via rotor 6 when operating shaft 26, acting as an operating section, is rotated. Resilient contacts 81 and 82 resiliently and in sliding fashion contact this contact plate 7, and configure rotary encoder 9, acting as a rotary section, for outputting signals. When operating shaft 26 is pressed, dome-shaped flexible contact 11 is pressed downward via driver 10 which contacts the bottom end of operating shaft 26. Pressed flexible contact 11 short-circuits between fixed contacts 121 and 122 to make switch 13, acting as a pressing section, output signals. Polygonal portion 261 of operating shaft 26 is fitted to polygonal hole 61 at the center of rotor 6 in a vertically movable fashion but rotates together with rotor 6.

Top substrate 22 holding electronic component 21 at its center is supported at rocking support 231 of frame 23 surrounding top substrate 22. Top substrate 22 is rotatable about first support pin 27 disposed at both sides of frame 23 on a first rocking axis M perpendicular to a rotation axis of operating shaft 26 of electronic component 21.

In addition, frame 23 is supported at rocking support 241 provided on the bottom substrate 24 beneath. This frame 23 is rockable about second support pin 28 disposed at both sides of bottom substrate 24 on second rocking axis N perpendicular to the rotation axis of operating shaft 26 and at right angles to first rocking axis M. In other words, top substrate 22 and bottom substrate 24 are rockably coupled to frame 23 by first support pin 27 on first rocking axis M and second support pin 28 on second rocking axis N intersecting at right angles to create a universal joint. Along first rocking axis M and second rocking axis N on bottom substrate 24, four push switches 251 to 254 are disposed at an equal distance from the crossing point of these two axes. These push switches 251 to 254 are auto-return switches, and have equal operation stroke and equal operation force. Push protrusions 221 to 224 on the bottom face of top substrate 22 contact buttons 255 and 258 of the push switches so as to maintain the space between the bottom face of top substrate 22 and bottom substrate 24 balanced in parallel in the normal state.

Furthermore, protrusions 225 to 228 are also provided on the bottom face of top substrate 22 on a bisector passing the crossing point of first rocking axis M and second rocking axis N at positions with equivalent distance from the crossing point to push switches 251 to 254. In other words, protrusions 225 to 228 are disposed at the middle of push protrusions 221 to 224. Gaps between these protrusions 225 to 228 and bottom substrate 24 are set to about 0.8 to 1.4 times the operation stroke of push switches 251 to 254.

The operation of the multidirectional input device as configured above in the first exemplary embodiment is described below.

First, when knob 29 mounted on operating shaft 26 of electronic component 21 is rotated in the normal state shown in FIG. 1, rotary encoder 9 as the rotary section outputs a signal; and when knob 29 is pressed, switch section 13 as the pressing section outputs a signal in the same way as in the prior art.

Figure 5:
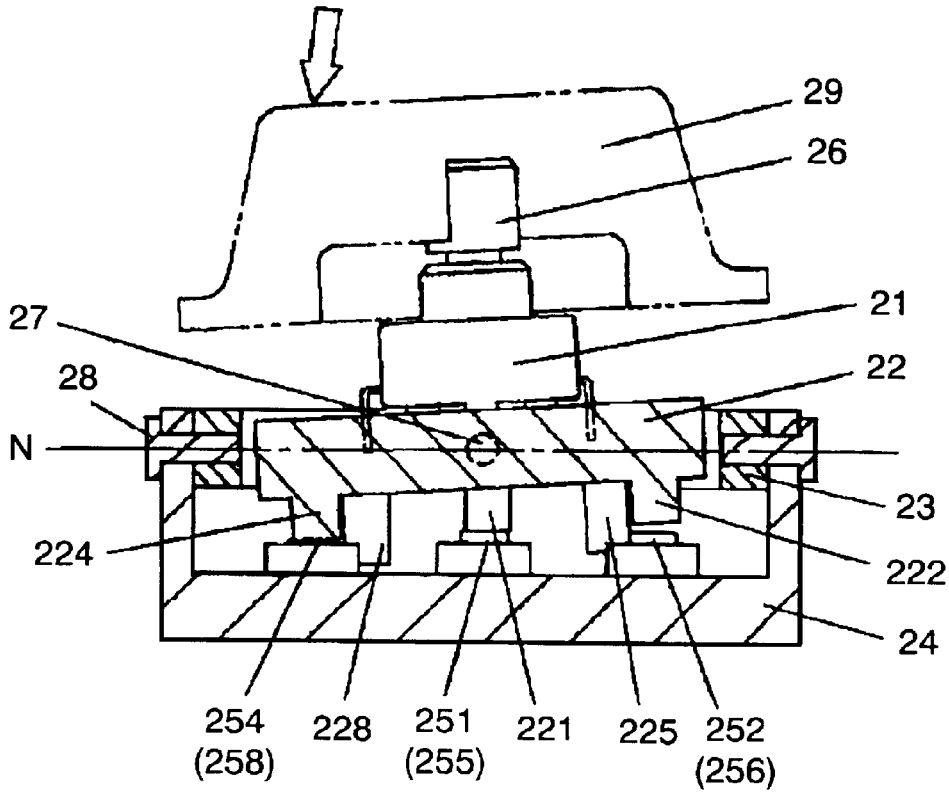
FIG. 5 is a front view, partly in section, when the operating shaft is tilted in FIG. 1.

Next, as shown by an arrow in the front view, partly in section, in FIG. 5, a signal is output when knob 29 is pressed and tilted to the left along second rocking axis N through the next steps. Top substrate 22 holding operating shaft 26 rotates to the left about first support pin 27 provided on first rocking axis M together with operating shaft 26, or electronic component 21, and tilts toward bottom substrate 24. Then, push protrusion 224 at the left on second rocking axis N moves downward to press button 258 and activate push switch 254 which outputs a signal. When the pushing force applied to knob 29 is released, button 258 of push switch 254 pushes back push protrusion 224, or top substrate 22, by its auto-return force, and knob 29 returns to the normal state.

In the same way, when knob 29 is tilted rightward, push switch 252 is activated to output a signal. When knob 29 is tilted forward or backward along first rocking axis M, top substrate 22 and frame 23 rock about second support pin 28 at both sides of bottom substrate 24 on second rocking axis N to activate respective push switches 253 or 251.

The next section describes operation when knob 29 is tilted not along first rocking axis M or second rocking axis N where four push switches 251 to 254 are disposed, but to the middle of these axes M and N. In this case, knob 29, or top substrate 22, tilts to the middle of both rocking axes as a result of the movement of the universal joint achieved by top substrate 22 rocking about first support pin 27, and frame 23 rocking about second support pin 28. However, as shown in FIG. 3, protrusions 225 to 228 are provided on the bottom face of top substrate 22 in these directions at positions with equivalent distance from the crossing point of both rocking axes to push switches 251 to 254. For example, when knob 29, or top substrate 22, is tilted in the direction where protrusion 225 is provided in FIG. 3, the following conditions need to be satisfied to activate push switch 251 or 252 closest in the tilted direction. Protrusion 225 needs to be pushed for more than $\sqrt{2}$ times the operation stroke of push switches 251 and 252 to press button 255 or 256 more than the switch operation stroke. However, as described previously, the gap between protrusions 225 to 228 and bottom substrate 24 is set at between 0.8 to 1.4 times the operation stroke, which is smaller than $\sqrt{2}$ times, of push switches 251 to 254. Accordingly, in the above example, protrusion 225 touches bottom substrate 24 before push switches 251 and 252 are activated.

As described above, push switches 251 to 254 thus do not activate when knob 29 is tilted to the middle and not along first rocking axis M and second rocking axis N where four push switches 251 to 254 are disposed.

When knob 29 is tilted in the direction along first rocking axis M or second rocking axis N where four push switches 251 to 254 are disposed, it is naturally necessary to arrange that protrusions close to this direction do not contact bottom substrate 24. Since the gap between protrusions 225 to 228 and bottom substrate 24 are set at 0.8 to 1.4 times, i.e., larger than $1/\sqrt{2}$ times, the operation stroke of push switches 251 to 254, protrusion 227 or 228 does not touch bottom substrate 24 before push switch 254, for example, activates.

Figure 6A:
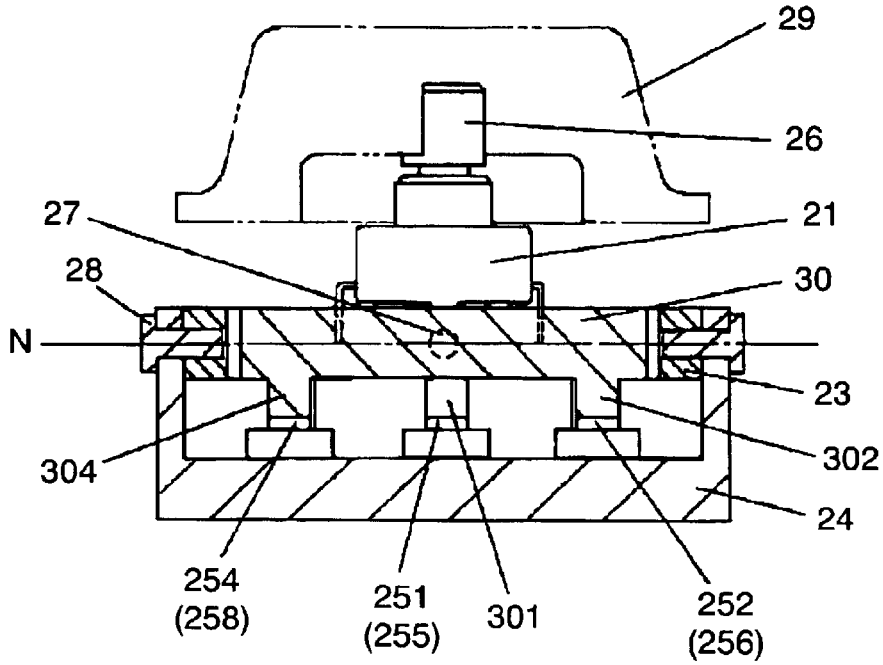
FIG. 6A is a front view, partly in section, of another example of a top substrate which is a key part in FIG. 1.
Figure 6B:
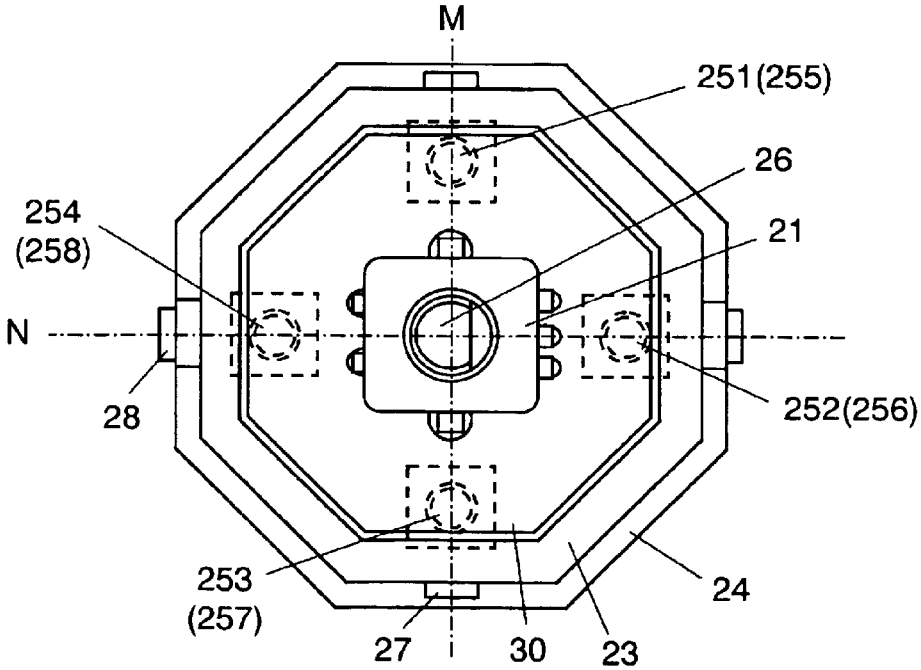
FIG. 6B is a plan view of the top substrate in FIG. 6A.

FIG. 6A is a front view partly in section and FIG. 6B is a plan view of an example of the multidirectional input device in the first exemplary embodiment with a configuration without protrusions 225 to 228 on the bottom face of top substrate 22 on the bisector passing the crossing point of first rocking axis M and second rocking axis N.

In other words, only push protrusions 301 to 304 corresponding to buttons 255 to 258 of four push switches 251 to 254 are provided on the bottom face of top substrate 30 along first rocking axis M and second rocking axis N. Even in this configuration, push switches 254 and 252 or 253 and 251 can be activated by tilting knob 29 to the right, left, front or back along first rocking axis M or second rocking axis N.

When knob 29 is tilted to the middle of first rocking axis M and second rocking axis N but not along these two axes, knob 29, or top substrate 30, tilts to the middle of both rocking axes in the same way as described above. For example, in FIG. 6B, when top substrate 30 tilts to the middle between two push switches 251 and 252, both push switches 251 and 252 activate, although there may be a slight time difference. In the same way, other combinations of two push switches can be activated simultaneously.

In this case, if switching recognition means (not illustrated) is provided for processing the case when two switches are activated within a predetermined time using a different signal from single switching, knob 29 can be tilted in eight directions, double the four directions along first rocking axis M and second rocking axis N, to output a signal.

As described above, the first exemplary embodiment allows an independent device to be assembled on bottom substrate 24. When knob 29 mounted on operating shaft 26 is rotated or pressed, a signal in response to this operation is output from electronic component for rotating and pressing operation 21. When knob 29 is tilted, top substrate 22 or 30 is tilted toward bottom substrate 24 and activate one or two of push switches 251 to 254 to output a signal. In addition, the first exemplary embodiment eliminates any looseness of knob 29 and realizes multidirectional input device with a comfortable tactile feedback when knob 29 is rotated.

Second Exemplary Embodiment

Figure 7:
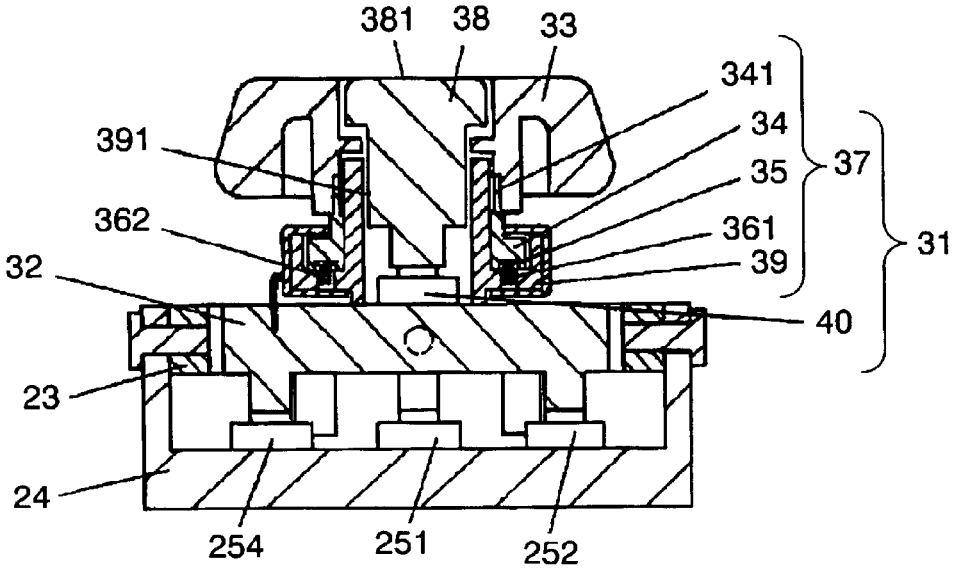
FIG. 7 is a front view, partly in section, of a multidirectional input device in accordance with a second exemplary embodiment of the present invention.

FIG. 7 is a front view, partly in section, showing a multidirectional input device in a second exemplary embodiment. As shown in FIG. 7, an electronic component for rotating and pressing operation of the multidirectional input device in the second exemplary embodiment has a configuration different from that in the first exemplary embodiment.

Electronic component for rotating and pressing operation 31 (hereafter simply referred as electronic component 31) held at the center of top substrate 32 of the multidirectional input device in this exemplary embodiment outputs a signal through the next steps. When hollow ring-shaped outer knob 33 is rotated, contact plate 35 held by rotor 34 integrally made with cylindrical outer shaft 341 also rotates. Resilient contacts 361 and 362 resiliently and in sliding fashion contacting contact plate 35 configure rotary encoder 37, acting as the rotary section, to output a signal. When inner knob 38 disposed at the center of outer knob 33 is pressed, push switch 40 disposed inside center hole 391 on base 39 of rotary encoder 37 outputs a signal, acting as the pressing section.

Inner knob 38 fits to center hole 391 on base 39 such that it moves vertically but without rotating, and its top face 381, exposed on the surface, displays operating functions of this multidirectional input device.

The configuration of frame 23 rotatably supporting top substrate 32, and bottom substrate 24 rotatably supporting this frame 23; and the operation that one or two of four push switches 251 to 254 disposed on bottom substrate 24 are activated by tilting outer knob 33 in a predetermined direction are the same as those in the first exemplary embodiment.

The multidirectional input device in the second exemplary embodiment as configured above requires two knobs, which are outer knob 33 and inner knob 38. However, the operating functions of the multidirectional input device can be displayed on top face 381 of fixed inner knob 38 in a readily visible fashion in a predetermined direction.

Third Exemplary Embodiment

Figure 8:
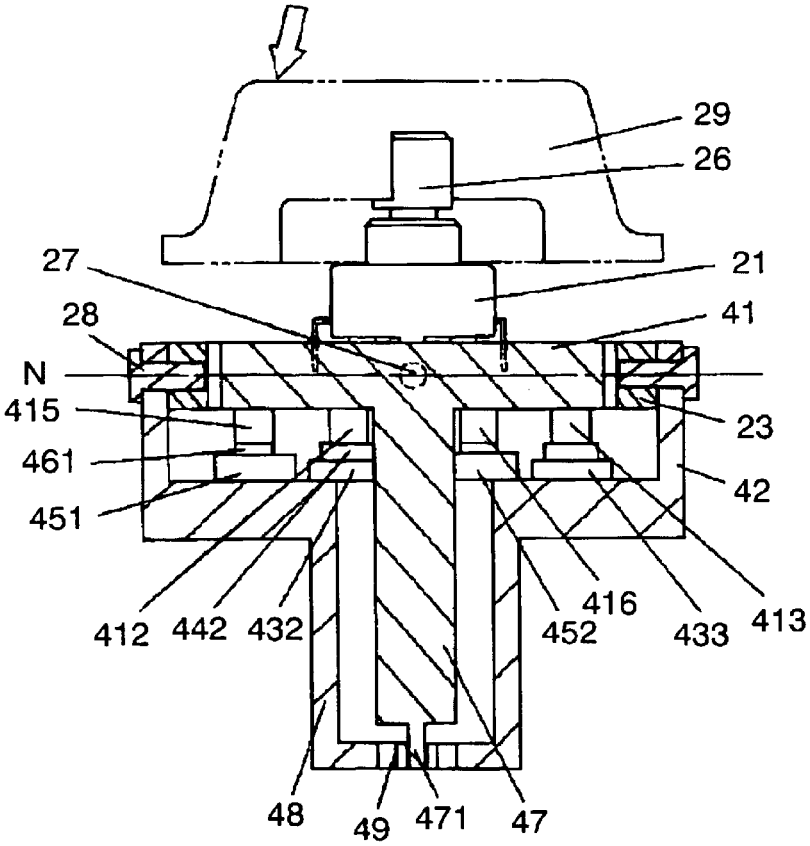
FIG. 8 is a front view, partly in section, of a multidirectional input device in accordance with a third exemplary embodiment of the present invention.
Figure 9:
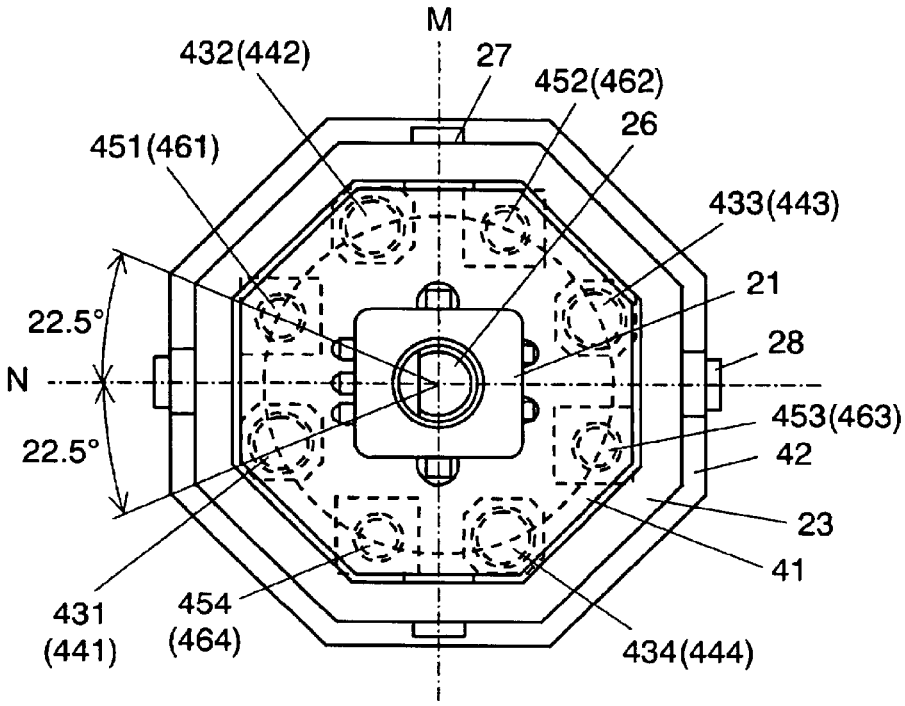
FIG. 9 is a plan view of the multidirectional input device in FIG. 8.
Figure 10:
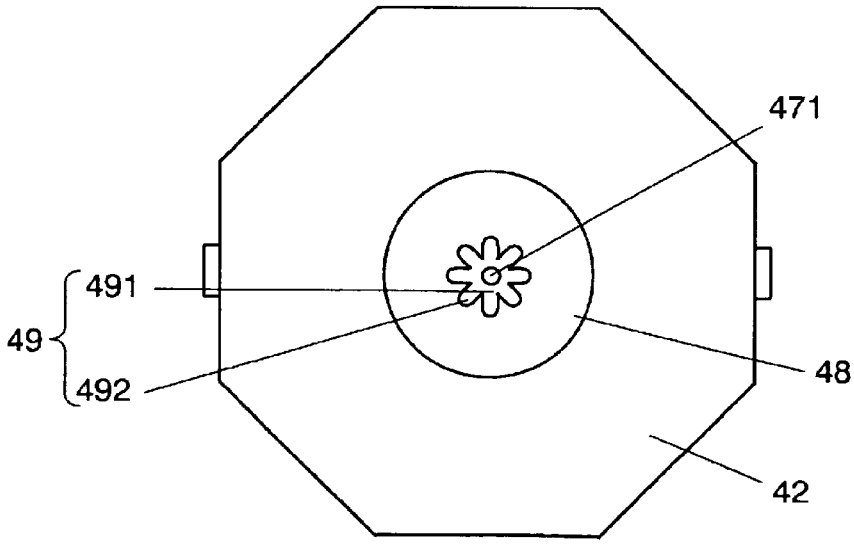
FIG. 10 is a bottom view of the multidirectional input device in FIG. 8.

FIG. 8 is a front view, partly in section, showing a multidirectional input device in a third exemplary embodiment. FIG. 9 is a plan view and FIG. 10 is a bottom view.

As shown in the drawings, the multidirectional input device in the third exemplary embodiment has top and bottom substrates and push switches disposed on the bottom substrate different from that of the first exemplary embodiment.

In the multidirectional input device in this exemplary embodiment, top substrate 41 holding electronic component for rotating and pressing operation 21 (hereafter simply referred as electronic component 21) at its center and bottom substrate 42 are rockably coupled to frame 23 by first support pin 27 on first rocking axis M and second support pin 28 on second rocking axis N intersecting at right angles to create a universal joint, same as in the first exemplary embodiment. However, in this exemplary embodiment, eight auto-return push switches 431 to 434 and 451 to 454 are alternatively disposed at an angular interval of 45° at angular positions of 22.5° respectively to both sides of first rocking axis M and second rocking axis N at an equal distance from the crossing point of first rocking axis M and second rocking axis N, as shown in FIG. 9.

The above four push switches 431 to 434 generate a tactile feedback and are activated by equally long operation stroke and equally applied force when buttons 441 to 444 are pressed. Other four push switches 451 to 454 activate without generating a tactile feedback by equally long operation stroke and equally applied force when buttons 461 to 464 are pressed. The operation stroke of push switches 431 to 434 which generate a tactile feedback is the same or longer than the operation stroke of push switches 451 to 454 which do not generate a tactile feedback.

Push protrusions 411 to 414 and 415 to 418 provided on the bottom face of top substrate 41 contact buttons 441 to 444 and 461 to 464 of eight push switches 431 to 434 and 451 to 454. In the normal state, these push protrusions balance the space between the bottom face of top substrate 41 and bottom substrate 42 balanced in parallel.

Moreover, small pin 471 at the tip of bar 47 extending downward from the bottom center of top substrate 41 along the rotation axis of operating shaft 26 of electronic component 21 is further extended downward from the bottom face of bottom substrate 42 and is inserted to tilt guide hole 49 on the bottom end of cylinder 48 surrounding bar 47.

This tilt guide hole 49, as shown in FIG. 10, has notches 492 in a direction corresponding to the tilting operation of operating shaft 26 around its center hole 491 having a diameter greater than small pin 471. These notches 492 are provided at the middle of adjacent push switches in eight push switches 431 to 434 and 451 to 454 disposed at an angular interval of 45°. In other words, notches 492 are provided at an angular interval of 45° in eight directions in total, giving four directions along first rocking axis M and second rocking axis N and four directions along the bisector passing the crossing point of these rocking axes.

The multidirectional input device in the third exemplary embodiment also has switching recognition means (not illustrated) for processing signals output when two adjacent switches of the eight push switches 431 to 434 and 451 to 454 are activated within a predetermined time as different signals respectively.

Next is described the operation of the multidirectional input device in the third exemplary embodiment as configured above.

The operation when knob 29 mounted on operating shaft 26 of electronic component 21 is rotated or pressed is the same as that in the first exemplary embodiment.

When knob 29 is tilted to the left along second rocking axis N by pressing knob 29 in the normal state, as shown by an arrow in FIG. 8, top substrate 41 rotates to the left about first support pin 27 on first rocking axis M, and tilts toward bottom substrate 42. Then, push protrusions 411 and 415 (not illustrated) at the left near second rocking axis N move downward. This action presses down buttons 441 and 461 and activates push switches 431 and 451 almost simultaneously to output signals. These signals are processed by the switching recognition means as one signal. Push switch 431 in push switches 431 and 451, which activate almost simultaneously, has an operation stroke that is the same or longer than that of push switch 451, and is designed to generate a tactile feedback on activation. Accordingly, two push switches 431 and 451 are activated without fail if knob 29 is pressed and tilted until push switch 431 generates a tactile feedback.

When this top substrate 41 rotates leftward, push protrusions 412 and 418 (not illustrated) close to first rocking axis M also move downward to press push buttons 442 and 464 of push switches 432 and 454. The amount of push protrusions 412 and 418 moving downward when push switches 451 and 431 corresponding to push protrusions 415 and 411 move downward of an operation stroke is at the ratio of (sin 22.5°/sin 67.5°) of the operation stroke, which is about 41%. Accordingly, push switches 432 and 454 do not activate.

Figure 11:
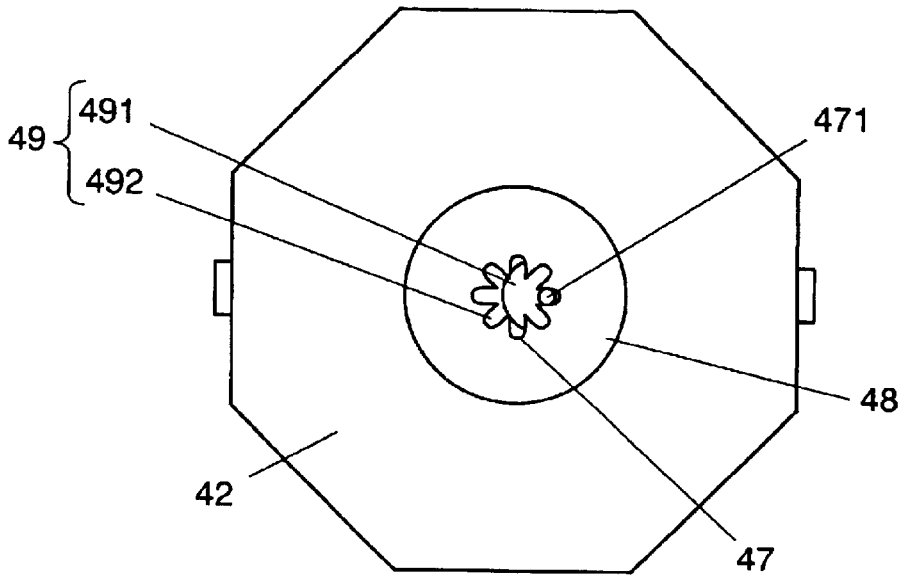
FIG. 11 is a bottom view when the operating shaft is tilted in FIG. 8.

Small pin 471 at the tip of bar 47 extended downward from the bottom center of top substrate 41 moves rightward from center hole 491 in tilt guide hole 49 on the bottom end of cylinder 48 extended from bottom substrate 42 when top substrate 41 rotates leftward. As shown in FIG. 11, small pin 471 enters right notch 492 so that it can guide knob 29, or top substrate 41, to tilt properly to the left along second rocking axis N.

When the force applied to knob 29 is released, the auto-return force of buttons 441 and 461 of push switches 431 and 451 push back push protrusions 411 and 415, or top substrate 41, and thus knob 29 returns to the normal state. Small pin 471 at the tip of bar 47 at the lower part of top substrate 41 also returns to center hole 491 in tilt guide hole 49.

In the same way, when knob 29 is tilted to the front, top substrate 41 and frame 23 rotates to the front about second support pin 28 on second rocking axis N, and push switches 434 and 454 are activated to output signals.

Small pin 471 at the tip of bar 47 at the lower part of top substrate 41 enters notch 492 across center hole 491 of tilt guide hole 49.

When knob 29 is tilted to the right back which is along the bisector passing the crossing point of first rocking axis M and second rocking axis N, knob 29 tilts to the right back as a result of the movement of the universal joint achieved by top substrate 41 rocking about first support pin 27 and frame 23 also rocking about second support pin 28, and activates push switches 433 and 452 to output a signals.

Accordingly, this exemplary embodiment offers a multidirectional input device which outputs signals by a uniform level of tilting operation of knob 29 mounted on operating shaft 26 in eight directions: along first rocking axis M and second rocking axis N perpendicular to the rotation axis of operating shaft 26, and to the middle of both rocking axes; while generating a tactile feedback.

Fourth Exemplary Embodiment

Figure 12:
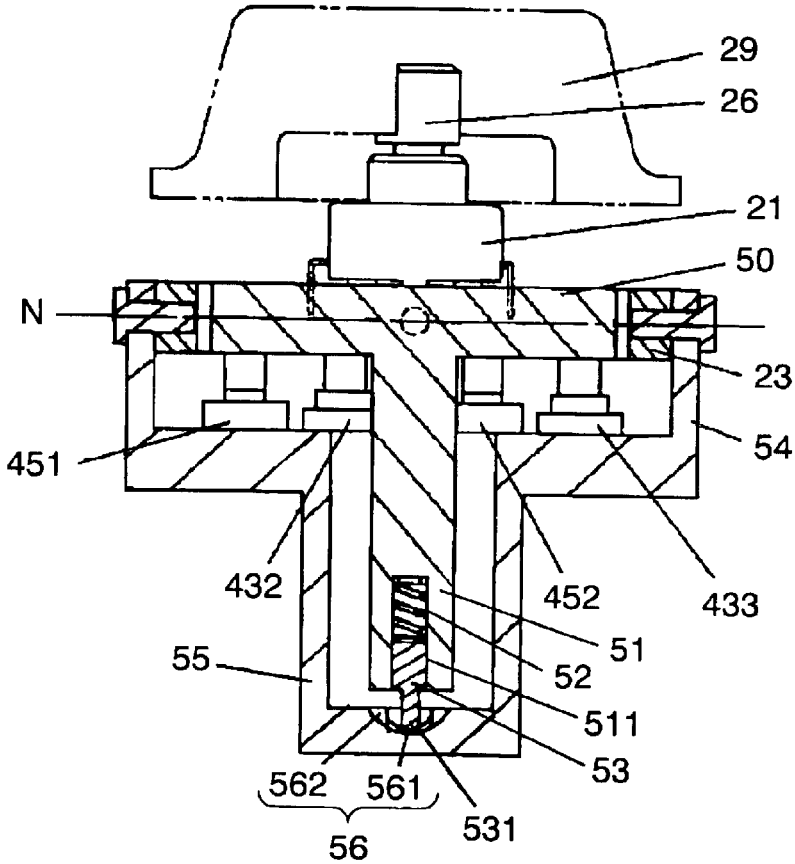
FIG. 12 is a front view, partly in section, of a multidirectional input device in accordance with a fourth exemplary embodiment of the present invention.

FIG. 12 is a front view, partly in section, showing a multidirectional input device in a fourth exemplary embodiment of the present invention. As shown in the drawing, the multidirectional input device in the fourth exemplary embodiment has a different configuration for a tilt guide formed on a part extended downward from the top and bottom substrates, compared to that in the third exemplary embodiment.

More specifically, cylinder 51 is extended downward along the rotation axis of operating shaft 26 of electronic component for rotation and pressing operation 21 from the bottom center of top substrate 50 pushing eight push switches 431 to 434 and 451 to 454. Guide pin 53 given a downward force by resilient member 52 is held in deep hole 511 at the bottom opening of cylinder 51 in a vertically movable fashion.

Tilt guide 56 is provided on bottom end of cylindrical body 55 extended downward from the bottom face of bottom substrate 54. On this tilt guide 56, eight notches 562 are created around spherical cavity 561 at the bottom center of cylindrical body 55 at positions corresponding to the tilting directions of operating shaft 26. This tilt guide 56 resiliently contacts spherical tip 531 of guide pin 53 held at the bottom of top substrate 50.

The shape of eight semi-spherical notches 562 around spherical cavity 561 of tilt guide 56 is similar to the top view of tilt guide hole 49 (FIG. 10) of the multidirectional input device in the third exemplary embodiment. Notches 562 are provided at the middle of adjacent switches in eight push switches 431 to 434 and 451 to 454. In other words, they are provided in eight directions in total at angular interval of 45°: four directions along the first rocking axis M and second rocking axis N, and four directions along the bisector passing the cross point of these rocking axes.

Other configurations of the multidirectional input device in the fourth exemplary embodiment are the same as those in the third exemplary embodiment.

The operation when knob 29 mounted on operating shaft 26 of the multidirectional input device as configured above is rotated or pressed is the same as that in the third exemplary embodiment, or first exemplary embodiment.

Since the center of spherical cavity 561 of tilt guide 56 is lowered, spherical tip 531 of guide pin 53 is given a force to stay at the center of spherical cavity 561 in the normal state, helping to maintain top substrate 50 and bottom substrate 54 in parallel.

Figure 13:
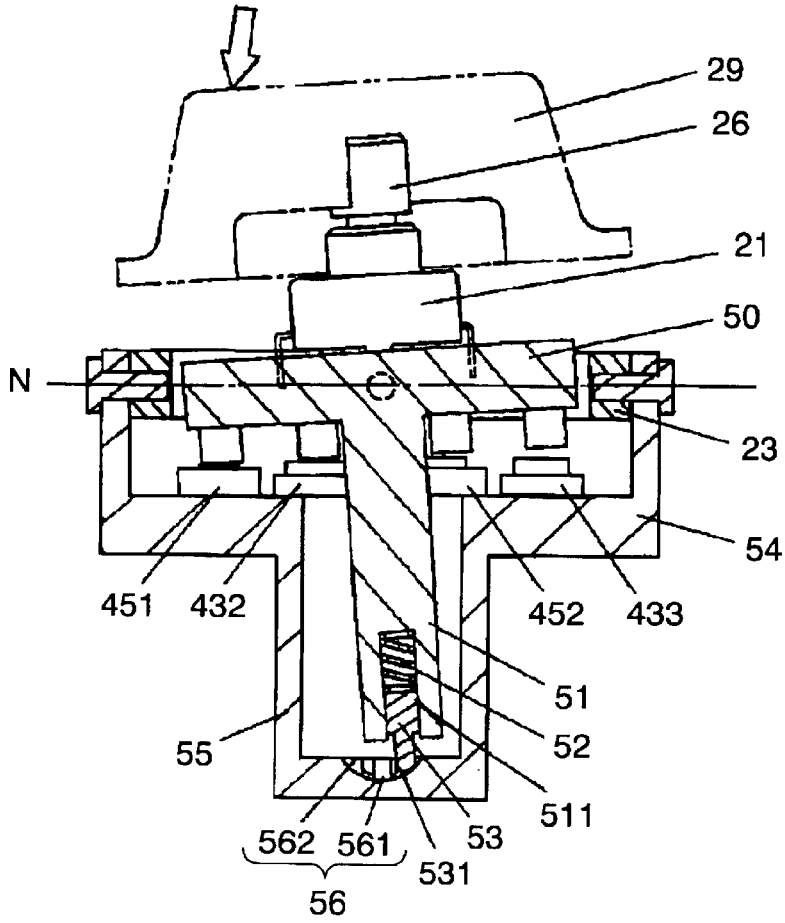
FIG. 13 is front view, partly in section, when the operating shaft is tilted in FIG. 12.
Figure 14:
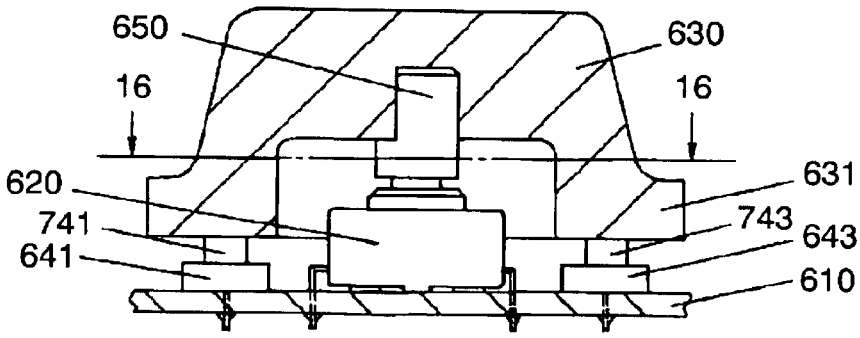
FIG. 14 PRIOR ART
FIG. 14 is a front view, partly in section, of a conventional multidirectional input device.
Figure 15:
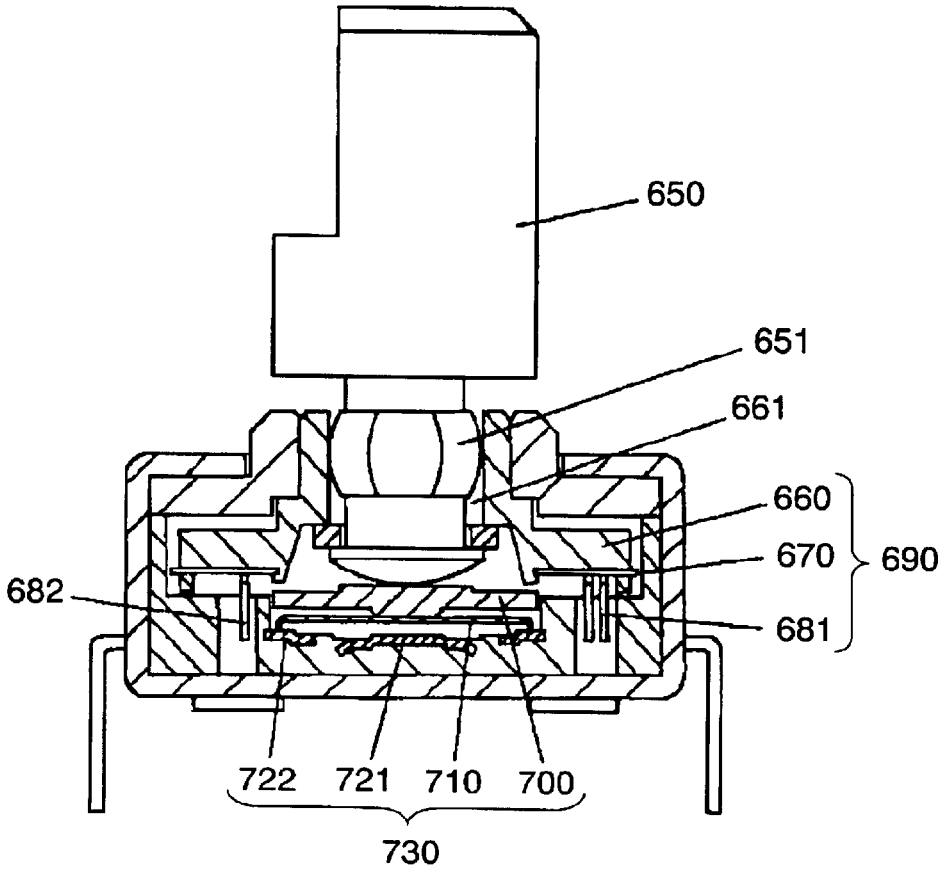
FIG. 15 PRIOR ART
FIG. 15 is a front sectional view of an electronic component for rotating and pressing operation which is a key part in FIG. 14.
Figure 16:
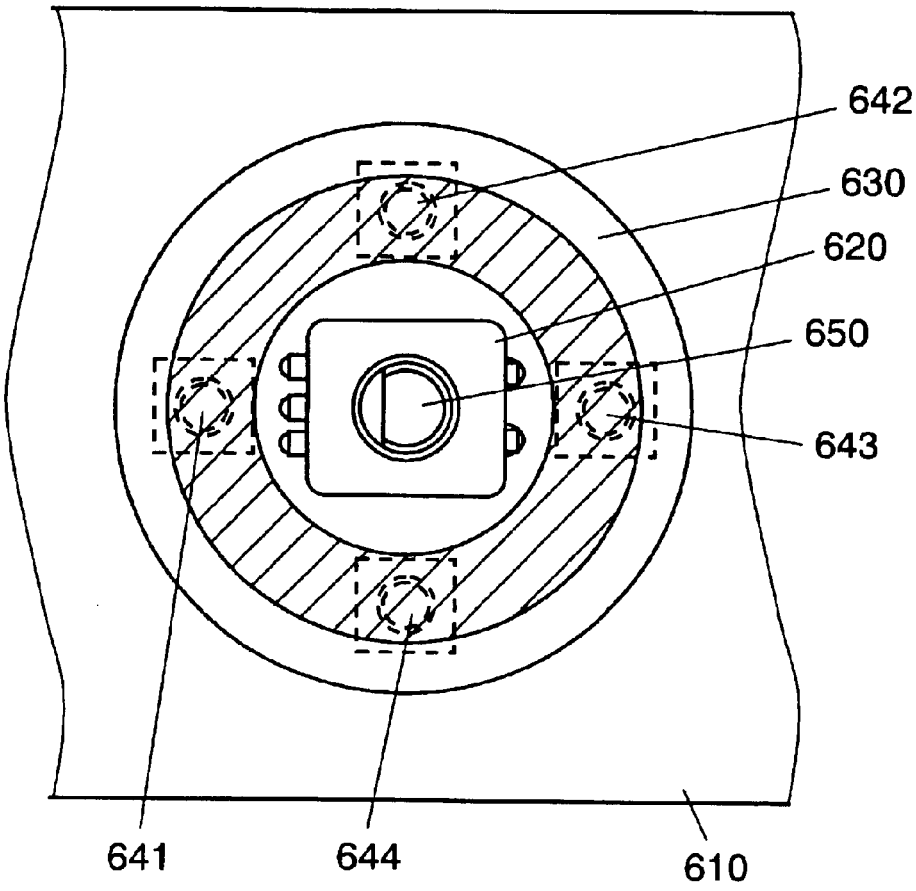
FIG. 16 PRIOR ART
FIG. 16 is a sectional view taken along 16—16 in FIG. 14.
Figure 17:
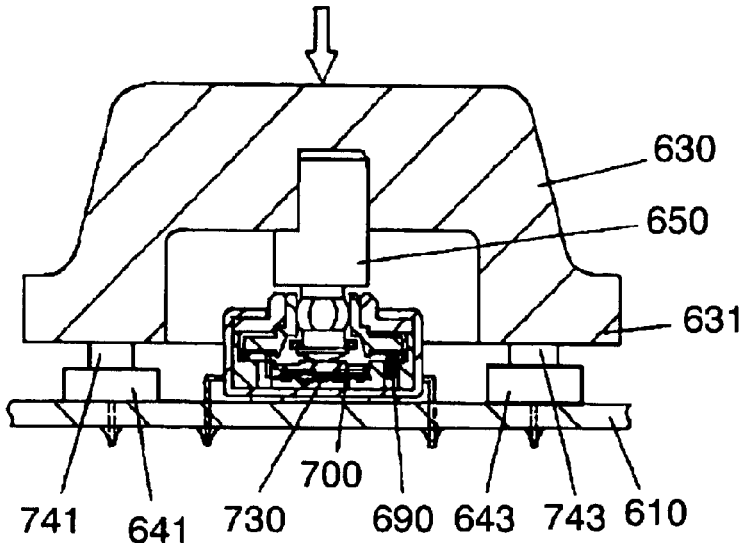
FIG. 17 PRIOR ART
FIG. 17 is a front view, partly in section, when the operating shaft is pressed in FIG. 14.
Figure 18:
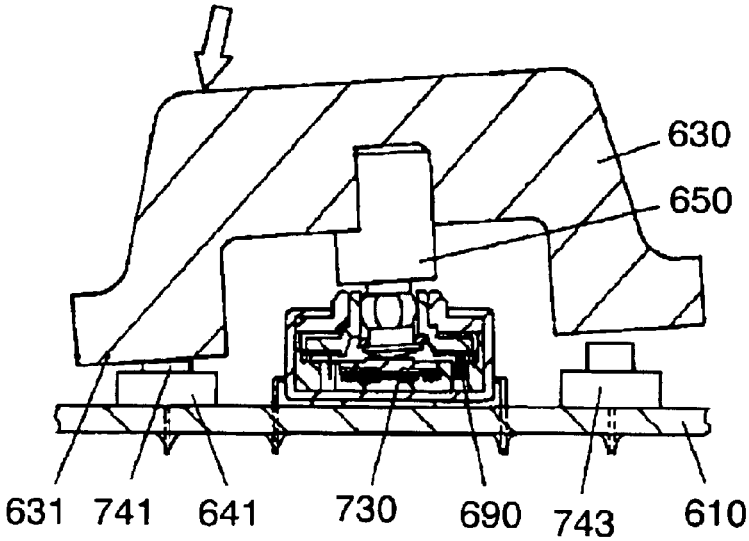
FIG. 18 PRIOR ART
FIG. 18 is a front view, partly in section, when the operating shaft is tilted in FIG. 14.

As shown by an arrow in a front view, partly in section, in FIG. 13, top substrate 50 rotates leftward and tilts toward bottom substrate 54 when knob 29 is tilted by applying a force to the top face of knob 29. Push switches 431 (not illustrated) and 451 are then activated almost simultaneously to output signals, in the same way as in the third exemplary embodiment.

However, when top substrate 50 rotates leftward, guide pin 53 held in deep hole 511 at the bottom of cylinder 51 extended downward from the bottom center of top substrate 50 moves rightward, and spherical tip 531 resiliently contacting tilt guide 56 at the bottom of cylindrical body 55 at the lower part of bottom substrate 54 moves rightward from the center of spherical cavity 561. Resilient member 52 is slightly compressed and enters semi-spherical notch 562 at the right so that it guides knob 29, or top substrate 50, to tilt properly to the left along second rocking axis N.

When the force applied to knob 29 is released, the auto-return force of push switches 431 and 451 push back top substrate 50. Here, guide pin 53 is also pushed by resilience of resilient member 52, and returns from semi-spherical notch 562 to the center of spherical cavity 561, helping top substrate 50 to return to the normal state.

As described above in the fourth exemplary embodiment, guide pin 53 held in cylinder 51 extended downward from top substrate 50 resiliently contacts tilt guide 56 at the bottom of cylindrical body 55 at the lower part of bottom substrate 54. When knob 29 mounted on operating shaft 26 is tilted, guide pin 53 guides knob 29 to operate in a right direction. In addition, guide pin 53 ensures knob 29 to return to the normal state after tilting by the operating section. Furthermore, the fourth exemplary embodiment offers a multidirectional input device which reduces erroneous operation even the knob is touched by mistake.

What is claimed is:

1. A multidirectional input device comprising:

(a) an electronic component outputting a signal in response to rotation and pressing of an operating section;

(b) a top substrate holding said electronic component at its center, said top substrate being rockable about a first support pin on a first rocking axis perpendicular to a rotation axis of said operating section;

(c) a frame surrounding said top substrate and having an rocking support for said first support pin, said frame being rockably supported by a second support pin on a second rocking axis perpendicular to said rotation axis and at right angles to said first rocking axis;

(d) a bottom substrate having a support for said second support pin; and (e) a plurality of push switches arranged at an equal distance and equal angular interval centering on a crossing point of said first rocking axis and said second rocking axis, said push switches being disposed on said bottom substrate in a way such that said push switches contact a bottom face of said top substrate;

wherein said top substrate tilts toward said bottom substrate by tilting said operating section, and then either one or two of said push switches are activated.

2. The multidirectional input device as defined in claim 1 further comprising a knob for operating said electronic component, said electronic component outputting a signal in response to rotation and pressing of said knob.

3. The multidirectional input device as defined in claim 1 further comprising a hollow outer knob for operating said electronic component and an inner knob in said hollow, said electronic component outputting a signal respectively in response to rotation of said outer knob and pressing of said inner knob.

4. The multidirectional input device as defined in claim 1, wherein four of said push switches are disposed on said first rocking axis and said second rocking axis.

5. The multidirectional input device as defined in claim 1, wherein a gap is created between a bottom face of said top substrate and said bottom substrate at a position with an equal distance from said crossing point to said push switches on a bisector passing said crossing point of said first rocking axis and said second rocking axis; said gap being 0.8 to 1.4 times an operation stroke of said push switches.

6. The multidirectional input device as defined in claim 5, wherein a protrusion is provided on said top substrate for securing said gap.

7. The multidirectional input device as defined in claim 1 further comprising switching recognition means, said means outputting a signal different from a signal for a single push switch when two of said push switches are activated simultaneously within a predetermined time.

8. The multidirectional input device as defined in claim 1, wherein eight of said push switches are disposed at angular positions of 22.5° to both sides of said first rocking axis and said second rocking axis, and said operating section is tiltable in directions of said first rocking axis and said second rocking axis and also to the middle of these axes.

9. The multidirectional input device as defined in claim 8 further comprising switching recognition means, said means outputting a signal different from a signal for a single push switch when two of said push switches are activated simultaneously within a predetermined time.

10. The multidirectional input device as defined in claim 8, wherein said push switches with a tactile feedback on activation and said push switches without a tactile feedback are disposed alternately.

11. The multidirectional input device as defined in claim 10, wherein an operation stroke of said push switches with a tactile feedback on activation is not shorter than an operation stroke of said push switches without a tactile feedback.

12. The multidirectional input device as defined in claim 1, wherein said top substrate has a small pin extended downward along the rotation axis, said bottom substrate has a center hole on a downward extended portion, and a notch is created around said center hole in a direction corresponding to said tilting so as to guide said small pin.

13. The multidirectional input device as defined in claim 1, wherein said top substrate has a guide pin in a cylinder extended downward along the rotation axis, said guide pin given a force by a resilient member; said bottom substrate has a spherical cavity on a downward extended portion; and a semi-spherical notch is created around said spherical cavity in a direction corresponding to said tilting so as to guide said guide pin.

* * * * *